United States Patent [19]

Taylor

[11] Patent Number: 5,012,623

[45] Date of Patent: May 7, 1991

[54] METHODS OF INTERLOCKING PANELS AND PANEL STRUCTURES USEFUL THEREIN

[75] Inventor: Duane F. Taylor, Salem, Oreg.

[73] Assignee: Janet R. Taylor, Salem, Oreg.

[21] Appl. No.: 497,463

[22] Filed: Mar. 22, 1990

[51] Int. Cl.[5] ..... E04D 3/362

[52] U.S. Cl. ..... 52/531; 52/478; 52/537; 52/747

[58] Field of Search ..... 52/519, 530, 531, 536, 52/537, 478, 747

[56] References Cited

U.S. PATENT DOCUMENTS

| | | | |
|---|---|---|---|
| 1,959,880 | 5/1934 | Sims | 52/531 X |
| 2,571,273 | 10/1951 | McCullough | 52/531 X |
| 3,363,380 | 1/1968 | Merrill . | |
| 4,106,250 | 8/1978 | Cummings et al. | 52/531 X |
| 4,201,026 | 5/1980 | Murphy | 52/531 X |
| 4,356,673 | 11/1982 | Gailey . | |
| 4,759,166 | 7/1988 | Hill, Sr. | 52/531 |
| 4,803,818 | 2/1989 | Funaki . | |
| 4,878,331 | 11/1989 | Taylor . | |
| 4,918,898 | 4/1990 | McLeod, Jr. | 52/537 X |

OTHER PUBLICATIONS

Bermuda Roofing Brochure.

*Primary Examiner*—Richard E. Chilcot, Jr.
*Attorney, Agent, or Firm*—Stole Rives Boley Jones & Grey

[57] ABSTRACT

The present invention is directed to methods of interlocking panels as well as panels and paneling kits useful in working those methods. The complete interlocked panel assembly resulting from working these methods exhibits a horizontal pattern, excellent wind uplift resistance and water tightness. Concealed fastening devices for panel-to-substrate affixation add to the water proofing and aesthetic qualities of the finished panel assemblies of the present invention. The self-interlocking panels of the present invention are easy to install, especially in that no external clips or other fasteners are necessary for panel-to-panel affixation. The interlocking panels of the present invention may be installed from the top of the underlying structure downward.

20 Claims, 4 Drawing Sheets

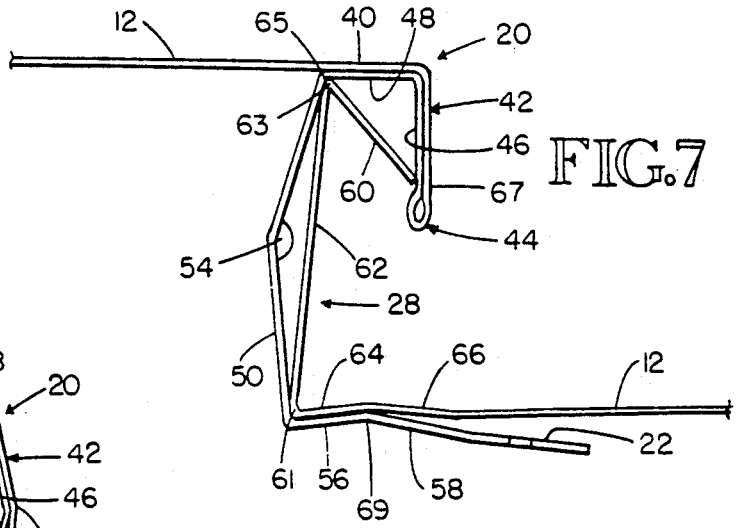
FIG. 7
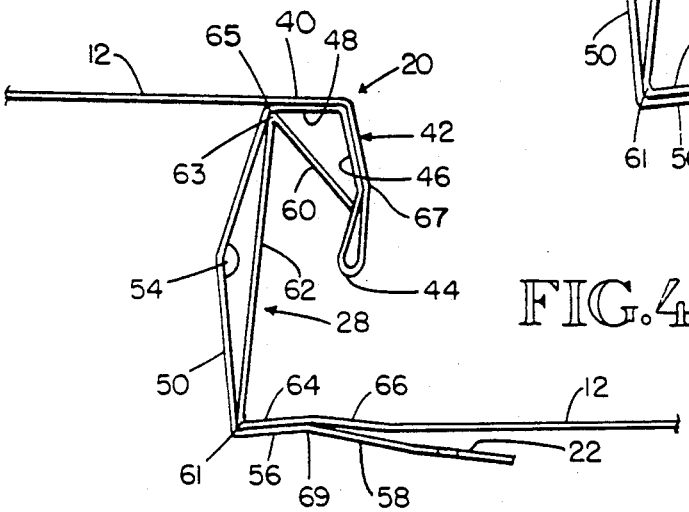
FIG. 4
FIG. 5
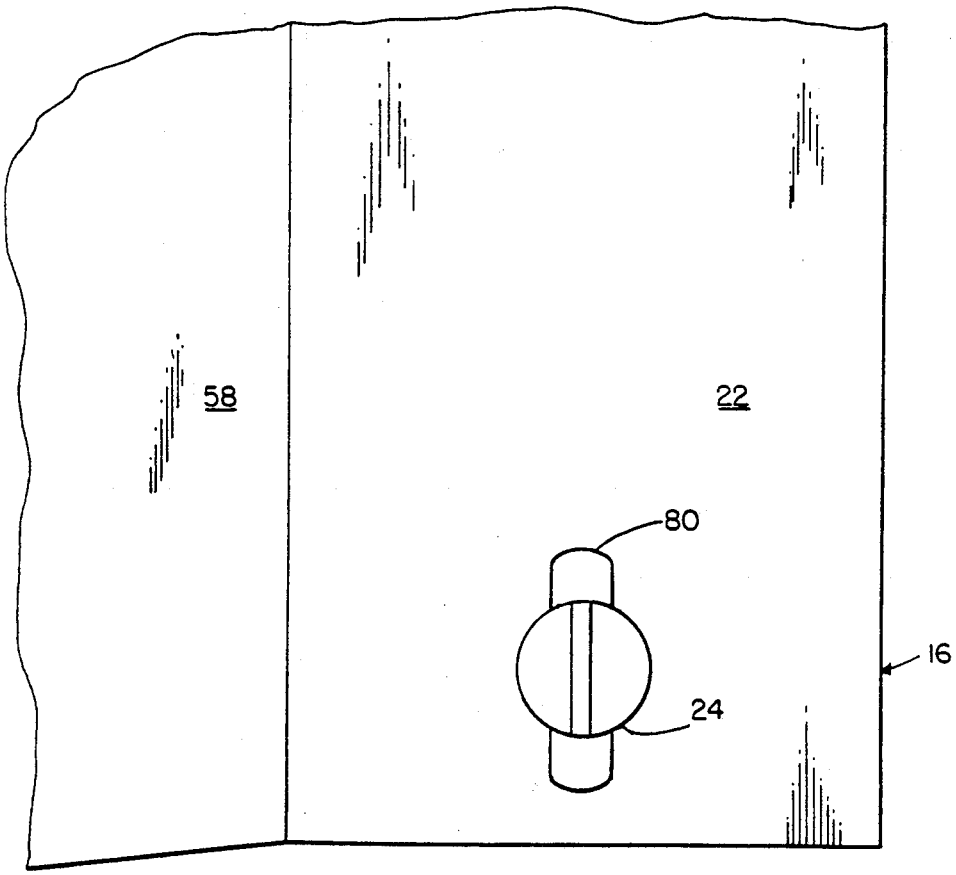

METHODS OF INTERLOCKING PANELS AND PANEL STRUCTURES USEFUL THEREIN

TECHNICAL FIELD

The present invention relates to methods of interlocking panels and panels useful in working such methods. In particular, the present invention is directed to placement of interlocking panels on an underlying substrate, such that a horizontal pattern emerges once a plurality of such panels have been installed. A horizontal roof pattern, for example, is a pattern that is symmetrical along a plane perpendicular to a line running along the slope of the roof and extending from the roof top to the roof bottom. Both panel assemblies and kits useful to construct such assemblies are also aspects of the present invention.

BACKGROUND OF THE INVENTION

Protection of structures, such as roofs and walls, through the use of panels constructed of protective materials, such as asphalt, slate or metal, is well known in the art. For example, U.S. Pat. No. 2,873,699 describes a metal roof protection structure, including a plurality of side-by-side interlocking roofing panels. Side-by-side locking panels produce a vertical pattern on a finished roof. Each panel is affixed to the underlying roof structure by driving a nail through the panel into a roof board. A next adjacent panel is positioned relative to the affixed panel, such that the nail head is covered and moisture is inhibited from seeping through the hole created by the nail and does not wet the underlying roof board. This panel joint structure does not completely inhibit water access to the nail head, however, because the panels fit snugly together (i.e., exhibit a "glove fit"), and capillary action produces movement of water between the panels to the region of the nail head.

Capillary and siphoning action has been recognized as a problem in the roofing industry. U.S. Pat. No. 4,878,331 describes a solution of this problem for the production of vertical roof patterns. This patent discusses vertical roofing panels having two interlocking ridges disposed on opposed longitudinal edges of the panel. One ridge is smaller than the other, and, when two such panels are interlocked, a space of sufficient size to disrupt capillary action is located between the top walls and/or between one set of side walls of the ridges of the two panels.

Also, the rigid attachment site of the panel design of U.S. Pat. No. 2,873,699 does not accommodate normal expansion and contraction of roofing panels in response to changing environmental temperatures. As a result, rigidly affixed panels are susceptible to buckling, cracking, deforming, and shearing of fastener heads.

Moreover, panels designed to produce horizontal patterns have encountered many problems not present or present to a lesser or different extent in installation of panel assemblies exhibiting vertical patterns. For example, horizontal patterns are subjected to different wind uplift conditions than are vertical patterns. Also, the process of installing roofing panels generating a horizontal roof pattern gives rise to greater concern regarding available roof work space than does installation of vertical roof patterning panels. The few roofing panels in existence designed to produce horizontal patterns require installation to occur from the bottom of the roof upward. This configuration necessitates that the roofer stand and work on some previously affixed panels to install other, higher roofing panels. The roofer's weight and work activity relative to affixed panels may damage those panels by bending or denting the panels or by scratching the panel finish.

U.S. Pat. Nos. 3,363,380 and 4,803,818 appear to discuss roofing panels designed to produce horizontal roof patterns. The first patent is directed to shingles. As discussed above with respect to panels designed to produce vertical roof patterns, capillary action is a recognized problem in the roofing industry. The shingles of this patent are joined in a glove fit manner at the portion of the shingle joint adjacent the underlying roof boards at the downhill end of each shingle. This partial glove fit shingle joint structure will permit water to seep into the joints therebetween by capillary action. Like other commercially available horizontal roofing panels, the panel of the second patent is not self-interlocking in that a locking member in addition to the panels themselves is required to lock the panels together. This additional component adds to the complexity and difficulty of the roofing process.

U.S. Pat. No. 4,356,673 is directed to siding panels that generate a horizontal pattern upon installation of a plurality of such panels. The patented siding panels are not self-interlocking, however. Consequently, the siding process is made more complex by the requirement of an additional component to lock the siding panels together.

SUMMARY OF THE INVENTION

The present invention is directed to interlocking panels, which include a primary panel portion having a housing disposed along the first longitudinal (i.e., downhill) side thereof and a locking portion disposed along the second longitudinal (i.e., uphill) side thereof. Panel housings of the present invention include an accepting mechanism, a directing mechanism, a tensioner, and an interlocking mechanism. The accepting mechanism of the housing permits introduction of a locking portion of a next adjacent panel into the housing. Directing mechanisms of the present invention direct the locking portion of the next adjacent panel into a relationship of maximum tension with the housing. The tensioner requires the housing to reversibly deform in response to a force exerted in installing the locking portion of the next adjacent panel, while the interlocking mechanism directs the locking portion of the next adjacent panel into a relationship of lesser tension within the housing and locks the next adjacent panel in that relationship. Interlocking panels of the present invention may also include other structural features, such as a joining mechanism to provide for panel-to-substrate fastening and a drip lip to enhance the water tightness of interlocked panels.

The present invention is also directed toward installation methods, involving interlocking panels, such as those described above, to form interlocked assemblies. The methods of the present invention include the steps of affixing a first panel to an underlying structure, where the first panel includes a housing opening in the downward or downhill direction (i.e., down along the slope of the substrate) at the lower portion thereof; introducing a locking portion of a next adjacent panel into the downward opening in the housing of the affixed panel; engaging the locking portion of the next adjacent panel with the directing mechanism of the housing of the affixed panel; directing the locking portion of the next adjacent panel into a maximum tension relationship with the affixed panel; and interlocking the affixed panel and the next adjacent panel under tension by directing the locking portion of the next adjacent panel into a relationship of lesser tension within the housing of the affixed panel and locking the next adjacent panel in that relationship. The methods of the present invention also optionally include one or more of the steps of interrupting water movement by capillary action and siphoning between interlocked panels; providing ventilation between interlocked panels; and moving affixed panels relative to the underlying structure.

Panel assemblies formed by the panels and/or methods of the present invention preferably feature a siphoning break formed between the housing portion of the affixed panel and the locking portion of a next adjacent panel. This siphoning break provides ventilation and interrupts water movement between interlocked panels of the present invention. Panel assemblies of the present invention may be constructed using paneling kits containing a plurality of the panels of the present invention and a plurality of fastening devices to affix the panels to an underlying structure.

In one embodiment, the present invention provides a roofing panel capable of top-to-bottom installation. The roofing panels of the present invention are also designed to prevent water seepage to underlying roof boards through capillary action. Roofing panels of the present invention also exhibit improved wind uplift resistance and allow movement of the panels relative to the underlying roof boards to accommodate expansion and contraction of roofing panels caused by changes in roofing panel environment.

The present invention is, therefore, also directed toward methods of roofing that result in finished roof structures exhibiting a horizontal pattern. These methods constitute an improvement over conventional roofing methods, in that top-to-bottom (i.e., downhill) installation is possible, and only two panels and a simple panel-to-roof board fastening device, such as a nail, are involved.

BRIEF DESCRIPTION OF THE DRAWINGS

FIG. 4 is a fragmentary elevational view of the interlocked sides of a pair of adjacent panels of the present invention.

FIG. 5 is an enlarged fragmentary top view of one side of a panel of the present invention and a fastener.

FIGS. *6a*, *6b*, *6c* and *6d* are a series of fragmentary elevational views of the interlocking sides of a pair of adjacent panels of the present invention showing the directions of the forces applied and generated for the stepwise procedure of installing the panels in accordance with the method present invention.

FIG. 7 is a fragmentary elevational view of the interlocked sides of a pair of adjacent panels of a second embodiment of the present invention.

DESCRIPTION OF PREFERRED EMBODIMENTS

Interlocking panels of the present invention may be used to protect underlying substrates of various types. Although the interlocking panels of the present invention are discussed below as roofing panels protecting a roof substrate, one of ordinary skill in the art will appreciate that other substrates, such as wall boards and the like, may also be paneled in accordance with the present invention.

Figure 1:
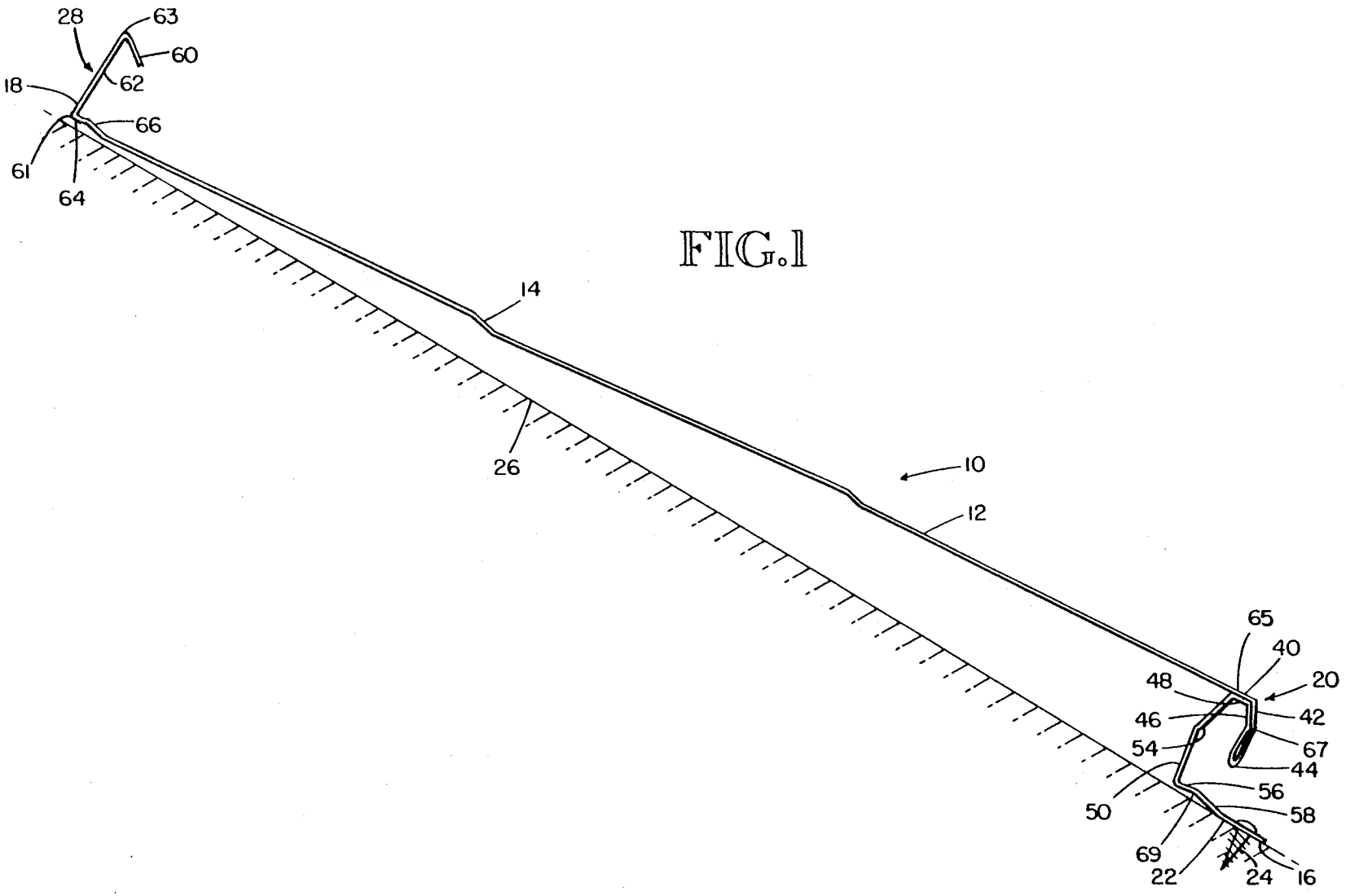
FIG. 1 is a schematic side elevational view of a panel of the invention shown fastened to an underlying sloped roof structure.

As shown in FIG. 1, roofing panel 10 is made up of a primary panel portion 12, having one or more accent ribs 14 that facilitate the production of more intricate horizontal roof patterns upon installation of the requisite number of roofing panels to cover the entire underlying roof structure. The number of and spacing between accent ribs 14 is a matter of design choice, and a practitioner in the art would be able to select these parameters to achieve a desired horizontal roof pattern. Primary panel portion 12 is optionally backed with foam, polystyrene, or the like to deaden sound and facilitate handling of roofing panels 10 during installation. Other conventional treatment processes may be used in conjunction with the roofing panels of the present invention, if so desired.

Figure 2:
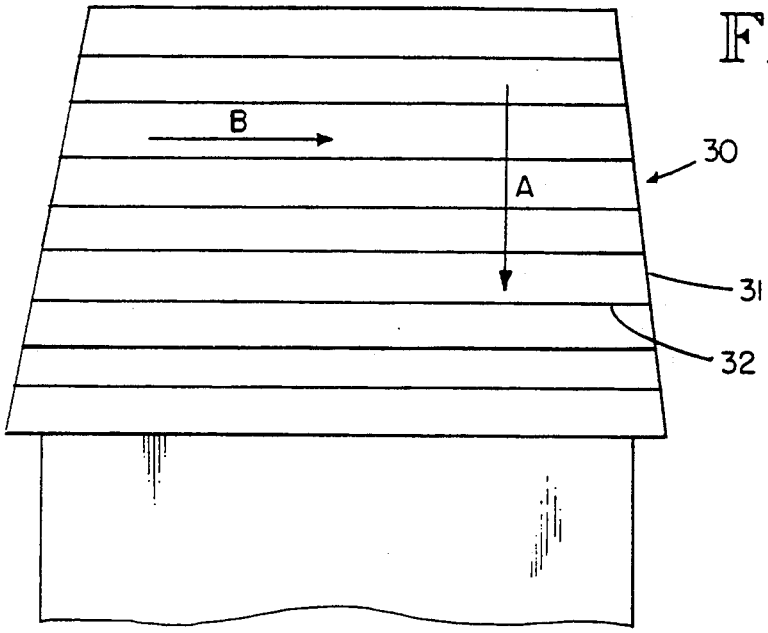
FIGS. 2 and 3 are schematic front views of finished roof assemblies having horizontal roof patterns.
Figure 3:
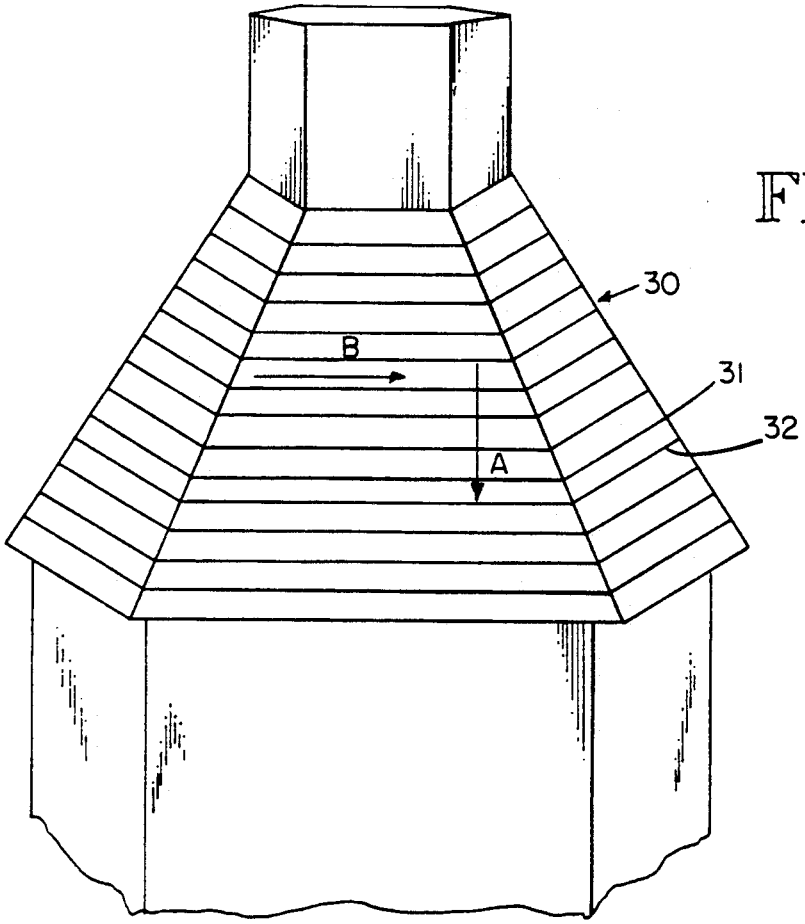

FIGS. 2 and 3 depict finished roofs 30, exhibiting typical horizontal roof patterns that can be obtained by installation of roofing panels 10 of the present invention. Arrow "A" in FIGS. 2 and 3 runs from the top of the roof to the bottom thereof. When the roof to be paneled is sloped, arrow A indicates the downward or downhill direction. Arrow "B" indicates the horizontal direction (i.e., the direction parallel to the resulting roof pattern). Panel ends 31 and panel sides 32 are shown for each horizontal roof design.

Roofing panel 10 of the present invention is generally produced from 22 to 28 gauge metal; however, any other metal gauge or other material capable of performing substantially similarly to 22 to 28 gauge metal in roofing applications may be used. Horizontal roofing panels may be sized to provide a number of different "coverages per panel." Coverage is measured in the vertical direction (i.e., the direction perpendicular to the long axis of the panel). Panels may be designed to exhibit any convenient coverage and any convenient length.

Roofing panel 10 has a first longitudinal side 16 (i.e., the downhill side) and a second longitudinal side 18 (i.e., the uphill side). A housing 20 is formed at first longitudinal side 16 of roofing panel 10 adjacent to primary panel portion 12. Housing 20 includes a fastening lip 22 through which a fastener 24, such as a screw, may be inserted to affix roofing panel 10 to an underlying roof board 26. A locking portion 28 is formed at second longitudinal side 18 of roofing panel 10 adjacent to primary panel portion 12. Housing 20 and locking portion 28 may be formed as separate portions and affixed to primary panel portion 12; however, formation of roofing panel 10 in a unitary fashion is preferred. Unitary roofing panels 10 may be formed on suitable existing roll forming equipment modified by a practitioner in the art designing tooling for this purpose. A plurality of roofing panels of the present invention are interlocked during the installation process to form a roofing assembly exhibiting a horizontal roofing pattern.

FIG. 4 depicts the self-interlocking sides of a pair of assembled roofing panels of the present invention. More specifically, FIG. 4 shows the interaction between housing 20 of one roofing panel and locking portion 28 of a next adjacent roofing panel. As used in this specification, the term "next adjacent roofing panel" refers to a roofing panel located along the slope of a roof in the direction defined by a line extending from the top of the roof downward (i.e., in the downhill direction) with respect to a reference roofing panel.

In this embodiment of the present invention, primary panel portion 12 extends to form a first top wall 40 of housing 20. Descending wall 42 of housing 20 inclines toward a next adjacent panel. Such an inclination is hereinafter referred to as an "outward" inclination. An exemplary inclination for descending wall 42 is 45°. A drip lip 44 extends between descending wall 42 and an ascending wall 46. Drip lip 44 may be inclined toward primary panel portion 12 of the roofing panel that includes housing 20 of the interlocked or assembled structure. Such an inclination is hereinafter referred to as an "inward" inclination. Drip lip 44 is sized and configured to encourage water, such as rain water, to run onto the primary panel portion of a next adjacent roofing panel rather than between adjacent panels in the area where housing 20 and locking portion 28 are joined. Drip lip 44 is preferably inwardly inclined (i.e., inclined in the uphill direction). An exemplary inclination for drip lip 44 is 45°. Descending wall 42 and ascending wall 46 are inclined at substantially the same angle and abut each other. A second top wall 48 of housing 20 lies beneath and abuts first top wall 40.

In another embodiment of the present invention shown in FIG. 7, ascending wall 46 and descending wall 42 are disposed at an angle of approximately 90° from first and second top walls 40 and 48. Drip lip 44 is sized and configured to encourage water, such as rain water, to run onto the primary panel portion of a next adjacent roofing panel rather than between adjacent panels in the area where housing 20 and locking portion 28 are joined. In this embodiment of the present invention drip lip 44 is disposed between ascending wall 46 and descending wall 42 and extends substantially along the same line as ascending wall 46 and descending wall 42.

A tensioning wall 50 of housing 20 extends from second top wall 48 to a locking ridge 56. Tensioning wall 50 is sized and configured to provide a camming surface for locking portion 28 of a next adjacent roofing panel. Additionally, tensioning wall 50 is sufficiently angled and flexible to allow deformation and maintenance of spring tension on the assembled joint with the application of force thereto during assembly. When no force is acting thereon, tensioning wall 50 is characterized by being bent at an original angle 54 in the downhill direction. An exemplary original angle 54 exhibited by tensioning wall 50 is 150°. When a force is acting upon tensioning wall 50, the angle 54 increases. Angle 54 will reach its maximum value at the time that the force acting on tensioning wall 50 is maximized. As the force acting on tensioning wall 50 is decreased, the angle 54 will decrease and substantially return to its original value.

Locking ridge 56 is located between tensioning wall 50 and a spring ramp 58 on housing 20 of roofing panel 10. Locking ridge 56 and spring ramp 58 are sized and configured to facilitate the interlocking of housing 20 and locking portion 28 of a next adjacent roofing panel. Fastening lip 22 is disposed at the other end of spring ramp 58.

Locking portion 28 includes a locking lip 60, a tension-creating wall 62, a first locking wall 64, and a second locking wall 66. Locking lip 60 is sized and configured to fit snugly in the vicinity of a joint 65 between tensioning wall 50 and second top wall 48, and a joint 67 between ascending wall 46 and drip lip 44. Additionally, locking lip 60, second top wall 48 and ascending wall 46 are sized and configured to provide between adjacent roofing panels 10 a space that is sufficient to provide ventilation and interrupt capillary or siphoning action therebetween.

Tension-creating wall 62 is sized and configured to exert a force on tensioning wall 50 during installation of a next adjacent roofing panel and to fit snugly under tension along tensioning wall 50 after installation. Moreover, a joint 63 between tension-creating wall 62 and locking lip 60 abuts tensioning wall 50 during installation, when tensioning wall 50 serves as a camming surface for joint 63.

In this embodiment, locking ridge 56 is shown as an inclined portion shaped to receive a correspondingly inclined first locking wall 64 of locking portion 28. Spring ramp 58 is configured to facilitate the process of interlocking adjacent panels and to receive a correspondingly inclined second locking wall 66 of locking portion 28, when the installation process is complete. More specifically, locking portion 28 is inserted into housing portion 20 by sliding locking portion 28 along spring ramp 58 and by exerting the required additional force to move beyond an apex 69 of spring ramp 58 into the interlocked position shown in FIG. 4. The method of interlocking adjacent panels is discussed further below in connection with FIGS. *6a–6d*.

Housing 20 may be any one of a variety of heights, depending on the role that the joint between housing 20 and locking portion 28 plays in the creation of the horizontal roof pattern, the horizontal length of primary panel portion 12, and other factors known to practitioners in the art. Locking portion 28 would be sized to fit within housing 20 under tension.

FIG. 5 depicts fastening lip 22 located between spring ramp 58 and first longitudinal side 16 of an embodiment of roofing panel 10 according to the present invention. Fastener 24 is housed within a slot 80 in fastening lip 22. In this manner, fastener 24 is easier to insert because it need only be inserted into the underlying roofing structure, rather than through both roofing panel 10 and the underling roofing structure. Slot 80 is sized and configured to permit roofing panel 10 to move relative to the underlying roofing structure to accommodate normal roofing material expansion and contraction resulting from changing weather conditions.

The number of slots 80 and/or fasteners 24 will depend on a number of factors, such as panel coverage and the like. A practitioner in the roofing art could determine these parameters for the roofing panels of the present invention. Paneling kits for installing roofing panel assemblies of the present invention will, therefore, contain a plurality of roofing panels 10, each panel 10 optionally having a single slot 80 or a plurality of slots 80 to facilitate panel-to-roof board affixation, and a plurality of fasteners 24 sufficient to affix the panels 10 to the underlying roof boards 26.

From the description of preferred embodiments of the present invention presented above, general features of the invention can be ascertained. For example, a siphoning break is useful for providing ventilation and preventing water movement between adjacent roofing panels. An exemplary siphoning break is shown in FIG. 4 as the open area between second top wall 48, ascending wall 46 and locking lip 60. Tensioning wall 50 is useful for maintaining locking portion 28 within housing 20 during all weather conditions, including winds of up to about 140 miles per hour. Drip lip 44 is useful in enhancing the water tightness of the paneled roof. An inclined or other camming surface, such as spring ramp 58, is useful to facilitate as well as direct installation of a next adjacent roofing panel. Additionally, decreasing the difficulty of fastener insertion and allowing roofing panels to move relative to the underlying roof structure to accommodate normal roofing panel expansion and contraction are useful objectives. Both of these objectives are accomplished in one exemplary embodiment of the present invention by fastener slot 80.

FIGS. 6*a*, 6*b*, 6*c* and 6*d* show a stepwise method of joining adjacent roofing panels in accordance with the present invention. In all four depictions, housing 20 of one roofing panel is affixed to an underlying roof structure by fastener 24. More specifically, a first roofing panel is placed on top of the underlying roof structure, such that longitudinal side 16 and fastening lip 22 of the first roofing panel are aligned horizontally on a roof board. Screw(s) 24 are then inserted, either through fastening lip 22 or through slot 80, to affix the first panel to the roof board.

Figure 6A:
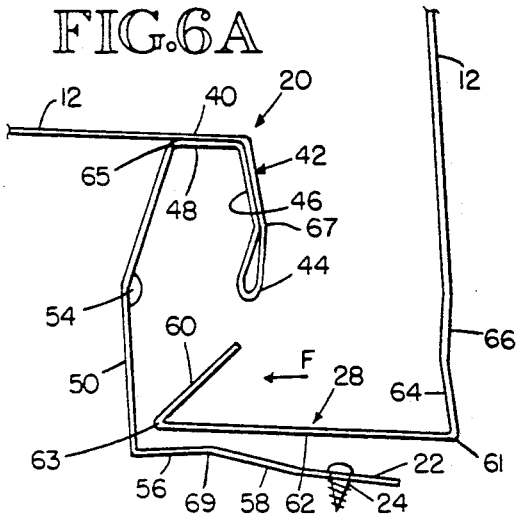
Figure 6B:
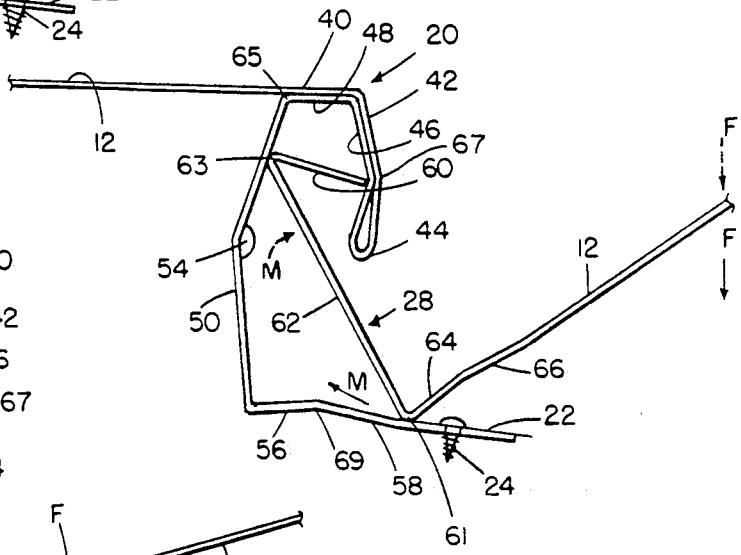
Figure 6C:
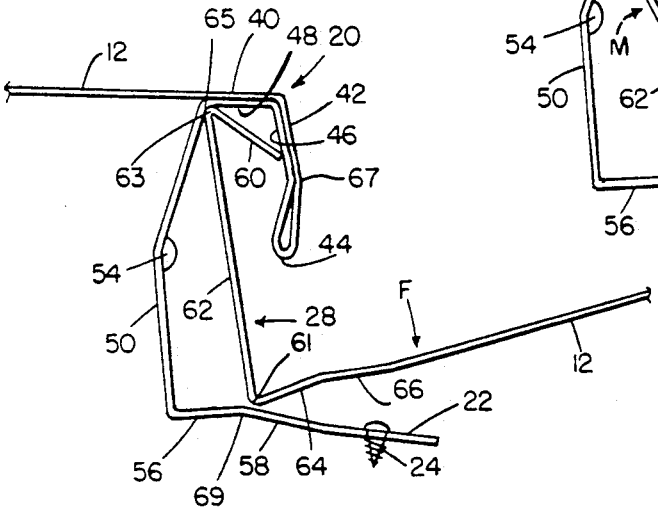
Figure 6D:
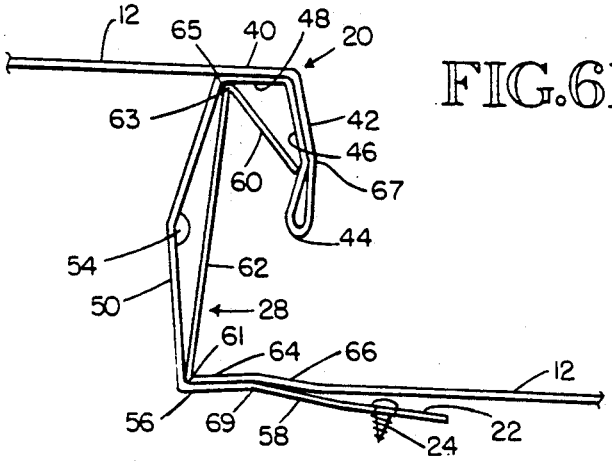

In FIGS. 6*a*, 6*b*, and 6*c*, presently acting forces and movements resulting therefrom are shown by solid arrows, and forces having acted to position the next adjacent roofing panel but no longer acting thereupon and the movements resulting therefrom are shown as dotted arrows. Force arrows are identified by an "F", and movement arrows are identified by an "M". When a force results in a movement of the panel portion on which the force directly acts in the same directions as the force, only the "F" arrow is shown.

FIG. 6*a* shows that the installation process requires that the next adjacent roofing panel be tilted, such that primary panel portion 12 of the next adjacent roofing panel is substantially perpendicular to primary panel portion 12 of the previously affixed roofing panel. A force, F, substantially parallel to fastening lip 22 of the affixed roofing panel and directed toward housing 20 of the affixed roofing panel, is applied to the next adjacent roofing panel to introduce locking lip 60 and a portion of tension-creating wall 62 of the next adjacent roofing panel into housing 20 of the affixed panel.

As indicated by the dotted arrows in FIG. 6*b*, a downward force, F, (i.e., a force substantially perpendicular to the previously applied force) is then applied to the next adjacent roofing panel to position a joint 61 of tension-creating wall 62 and first locking wall 64 of the next adjacent roofing panel on spring ramp 58 of the affixed roofing panel. This force further positions joint 63 between locking lip 60 and tension-creating wall 62 along tensioning wall 50. The downward force also positions locking lip 60 of the next adjacent panel within the opening formed by tensioning wall 50, second top wall 48, ascending wall 46, and drip lip 44 of the affixed panel, with the outwardly (i.e., downhill) directed end of locking lip 60 positioned in joint 67 between ascending wall 46 and drip lip 44.

The solid arrows in FIG. 6*b* indicate that additional force, F, directed substantially downward toward fastening lip 22 of the affixed panel, is applied to the next adjacent panel to slide joint 61 along spring ramp 58 of the affixed roofing panel. This force also serves to cause joint 63 to exert a force upon tensioning wall 50, slightly straightening tensioning wall 50 (i.e., slightly increasing angle 54). As joint 61 continues to slide along spring ramp 58 toward apex 69 (i.e., the point of maximum tension), drip lip 44 is outwardly displaced (i.e., displaced in the downhill direction). When joint 61 reaches apex 69, housing 20 and locking portion 28 are in a maximum tension relationship. Consequently, angle 54 is at its maximum value, and drip lip 44 of the affixed panel is maximally displaced by the force exerted thereon by locking lip 60 of the next adjacent panel.

The final position of the adjacent panels achieved by deployment of the forces described in connection with FIG. 6*b* is shown in FIG. 6*c*. FIG. 6*c* further indicates that the interlocking of housing 20 of the affixed roofing panel and locking portion 28 of the next adjacent roofing panel can be completed by an additional application of a downward force, F, to the next adjacent roofing panel. This additional force slides joint 61 past apex 69. As joint 61 moves beyond apex 69, the tension that locking portion 28 undergoes decreases below the maximum value thereof; however, locking portion 28 remains under tension within housing 28 due to the spring tension of tensioning wall 50 which maintains a locking force on the next adjacent panel. Once first locking wall 64 substantially abuts locking ridge 56, the two panels will be interlocked in the locked position depicted in FIG. 6*d*, which is a duplicate of FIG. 4. When affixing panels ultimately configured as shown in FIG. 7, the forces applied to the panels and movements of the panels resultant therefrom are substantially the same as those described above.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

I claim:

1. A method of installing adjacent interlocking panels over an underlying structure, wherein the installation progresses in a direction from the top of the structure downward, the method comprising:
   - affixing to the underlying structure a first panel comprising a housing opening in the downward direction;
   - introducing a locking portion of a second panel into the downward opening in the housing of the first panel;
   - engaging the locking portion of the second panel with a directing mechanism of the housing of the first panel;
   - directing the locking portion of the second panel into a maximum tension relationship with the first panel; and
   - interlocking the affixed panel and the second panel under tension by directing the locking portion of the second panel into a relationship of lesser tension within the housing of the first panel and locking the second panel in the relationship of lesser tension.

2. A method of claim 1, further comprising interrupting water movement by capillary or siphoning action between interlocked panels.

3. A method of claim 1, further comprising providing ventilation between interlocked panels.

4. A method of claim 1, further comprising moving panels relative to the underlying structure.

5. An interlocking panel capable of being installed from the top of an underlying structure downward and of generating a horizontal pattern upon installation of a plurality of panels of substantially similar type, the panel comprising:

a primary panel portion having an uphill side and a downhill side;

a housing disposed along the downhill side of the primary panel portion, the housing comprising an accepting mechanism, a directing mechanism, a tensioner, and an interlocking mechanism; and a locking mechanism disposed along the uphill side of the primary panel portion, wherein the accepting mechanism permits introduction of a locking mechanism of a next adjacent panel into the housing;

wherein the directing mechanism directs the locking mechanism of the next adjacent panel into a relationship of maximum tension with the housing of the panel;

wherein the tensioner causes the housing to reversibly deform in response to a force exerted in installing the locking mechanism of the next adjacent panel;

wherein the interlocking mechanism directs the locking mechanism of a next adjacent panel into a relationship of lesser tension within the housing and locks the next adjacent panel in that relationship.

6. An interlocking panel according to claim 5, further comprising a joining mechanism for affixing the panel to the underlying structure, wherein the joining mechanism permits movement of the panel relative to the underlying structure.

7. An interlocking panel according to claim 6, wherein the panel is configured, such that the joining mechanism is concealed upon installation of the next adjacent panel.

8. An interlocking panel according to claim 6, wherein the joining mechanism provides direct access to the underlying structure, thereby permitting the panel and the underlying structure to be joined, without perforation of the panel.

9. An interlocking panel according to claim 5, wherein the accepting mechanism comprises a downwardly opening channel.

10. An interlocking panel according to claim 5, wherein the directing mechanism comprises an inclined wall.

11. An interlocking panel according to claim 5, wherein the tensioner comprises an angled, reversibly deformable tensioning wall.

12. An interlocking panel according to claim 5, wherein the interlocking mechanism comprises a locking ridge.

13. An interlocking panel according to claim 5, wherein the housing further comprises a drip lip.

14. An interlocking panel according to claim 13, wherein the drip lip is capable of reversible deformation in the downhill direction.

15. A paneling kit for paneling an underlying structure from an uphill side to a he downhill side thereof, the paneling kit comprising:

a plurality of interlocking panels according to claim 5;

and a plurality of fastening devices capable of affixing the panels to the underlying structure.

16. A paneling kit according to claim 15, wherein each interlocking panel comprises a fastening lip disposed at the downhill side of the panel having a slot disposed therein to permit fastening of the panel to the underlying structure with a fastening device without piercing the panel.

17. A paneling kit according to claim 15, wherein the interlocking panels are configured, such that the fastening devices are concealed upon installation of adjacent panels.

18. An interlocked panel assembly comprising a plurality of interlocking panels capable of being installed from the top of an underlying structure downward and of generating a horizontal pattern, each interlocking panel in the panel assembly comprising:

a primary panel portion having an uphill side and a downhill side;

a housing disposed along the downhill side of the primary panel portion, the housing comprising an accepting mechanism, a directing mechanism, a tensioner, and an interlocking mechanism; and a locking mechanism disposed along the uphill side of the primary panel portion, wherein the accepting mechanism permits introduction of a locking mechanism of a next adjacent panel into the housing;

wherein the directing mechanism directs the locking mechanism of the next adjacent panel into a relationship of maximum tension with the housing of the panel;

wherein the tensioner causes the housing to reversibly deform in response to a force exerted in installing the locking mechanism of the next adjacent panel;

wherein the interlocking mechanism directs the locking mechanism of a next adjacent panel into a relationship of lesser tension within the housing and locks the next adjacent panel in that relationship.

19. An interlocked panel assembly according to claim 18, wherein the housing and the locking mechanism define a siphoning break therebetween, and wherein the siphoning break provides ventilation and interrupts water movement between interlocked panels.

20. An interlocked panel assembly according to claim 18, capable of withstanding winds of up to about 140 miles per hour.

* * * * *